US007795795B2

(12) United States Patent
Iba et al.

(10) Patent No.: US 7,795,795 B2
(45) Date of Patent: Sep. 14, 2010

(54) ELECTRON BEAM APPARATUS HAVING AN ELECTRODE WITH HIGH TEMPERATURE PORTION

(75) Inventors: Jun Iba, Yokohama (JP); Hisanobu Azuma, Hadano (JP)

(73) Assignee: Canon Kabushiki Kaisha, Tokyo (JP)

( * ) Notice: Subject to any disclaimer, the term of this patent is extended or adjusted under 35 U.S.C. 154(b) by 258 days.

(21) Appl. No.: 12/054,051

(22) Filed: Mar. 24, 2008

(65) Prior Publication Data

US 2008/0238287 A1 Oct. 2, 2008

(30) Foreign Application Priority Data

Apr. 2, 2007 (JP) ..... 2007-096402

(51) Int. Cl.
*H01J 1/62* (2006.01)
*H01J 63/04* (2006.01)

(52) U.S. Cl. ..... 313/495; 313/310; 313/497; 313/498; 427/78; 315/169.3

(58) Field of Classification Search ..... 313/495–498
See application file for complete search history.

(56) References Cited

U.S. PATENT DOCUMENTS

| | | | | |
|---|---|---|---|---|
| 5,023,110 | A | 6/1991 | Nomura et al. | 427/49 |
| 6,703,791 | B2 | 3/2004 | Azuma | 315/169.3 |
| 6,707,061 | B2 | 3/2004 | Komoda et al. | 257/10 |
| 6,803,717 | B2 * | 10/2004 | Ohnishi | 313/495 |
| 6,972,203 | B2 | 12/2005 | Azuma | 438/20 |
| 7,151,005 | B2 | 12/2006 | Azuma | 438/20 |
| 7,382,088 | B2 | 6/2008 | Azuma et al. | 313/495 |
| 2003/0020059 | A1 | 1/2003 | Komoda et al. | 257/10 |
| 2006/0063459 | A1 | 3/2006 | Iba et al. | 445/3 |
| 2006/0087219 | A1 | 4/2006 | Taniguchi et al. | 313/495 |

(Continued)

FOREIGN PATENT DOCUMENTS

JP 2-56822 2/1990

(Continued)

OTHER PUBLICATIONS

Jüttner, B. et al., "Cathode Spots", Handbook of Vacuum Arc Science and Technology, Noyes Publications, NJ (1995), pp. 80-89.

(Continued)

*Primary Examiner*—Sikha Roy
*Assistant Examiner*—Tracie Green
(74) *Attorney, Agent, or Firm*—Fitzpatrick, Cella, Harper & Scinto

(57) ABSTRACT

The invention provides an electron beam apparatus having: a rear plate having a plurality of electron-emitting devices each provided with a device electrode, and a plurality of wirings connected to the device electrodes; and a face plate being provided with an anode electrode, and being arranged in opposition to the rear plate so as to be irradiated with an electron emitted from the electron-emitting device, wherein the device electrode is electrically connected to the wiring through an additional electrode, and the additional electrode is formed from an electroconductive material of which phase transition from a solid phase directly into a vapor phase is caused at a temperature not lower than a melting point of the device electrode within an evacuated atmosphere.

7 Claims, 10 Drawing Sheets

U.S. PATENT DOCUMENTS

| | | | | |
|---|---|---|---|---|
| 2006/0087220 | A1 | 4/2006 | Hiroki et al. | 313/495 |
| 2006/0164001 | A1 | 7/2006 | Iba et al. | 313/495 |
| 2007/0020787 | A1 | 1/2007 | Azuma | 438/20 |

FOREIGN PATENT DOCUMENTS

| | | |
|---|---|---|
| JP | 05-299010 | 11/1993 |
| JP | 2002-343230 | 11/2002 |

OTHER PUBLICATIONS

Djakov, B. E., *Cathode Spot Phenomena in Low Current Vacuum Arcs on Arc-Cleaned Electrode Surfaces*, Contrib. Plasma Phys., 33 (1993) 4, pp. 307-316.

* cited by examiner

ELECTRON BEAM APPARATUS HAVING AN ELECTRODE WITH HIGH TEMPERATURE PORTION

BACKGROUND OF THE INVENTION

1. Field of the Invention

The present invention relates to an electron beam apparatus which uses electron-emitting devices and which is applied to a flat panel type image display apparatus (flat panel display) and, more particularly, to an electron beam apparatus having a feature in an electrode construction of a rear plate.

2. Description of the Related Art

Hitherto, an image forming apparatus can be mentioned as a using form of electron-emitting devices. For example, there is a flat panel type electron beam display panel in which an electron source substrate (rear plate) formed with a number of cold cathode electron-emitting devices and an opposite substrate (face plate) having anode electrodes each for accelerating an electron emitted from the electron-emitting device and a light-emitting member are arranged in parallel so as to face each other and the inside of the display panel has been evacuated in vacuum. According to the flat panel type electron beam display panel, a lighter weight and a larger screen can be realized as compared with those of a cathode ray tube (CRT) display apparatus which is widely used at present. An image of higher luminance and higher quality can be also provided as compared with those of a flat panel type display panel using a liquid crystal or another flat panel type display panel such as plasma display, electroluminescence display, or the like.

In the image forming apparatus of the type in which a voltage is applied between the anode electrode and the device in order to accelerate the electron emitted from the cold cathode electron-emitting device as mentioned above, it is advantageous to apply a high voltage in order to obtain the maximum light-emitting luminance. Since the emitted electron beam is diverged depending on a device type until it reaches a counter electrode, in order to realize the display with high resolution, it is desirable that an interplate distance between the rear plate and the face plate is short.

However, if the interplate distance is short, since an electric field between the plates inevitably becomes high, such a phenomenon that the electron-emitting device is broken by a discharge is liable to occur.

In Patent Document 1 (Japanese Patent Application Laid-Open No. H05-299010), there has been disclosed such a construction that in an electron source of a field emission type, by providing a fusing portion between a field emission electrode and an electric supply line, an influence on a peripheral portion that is caused due to a short-circuit which has occurred locally is suppressed. In Patent Document 2 (Japanese Patent Application Laid-Open No. 2002-343230), there has been disclosed such a construction that in an electron source of a field emission type, by providing a narrow portion between a surface electrode and a bus electrode, the narrow portion is disconnected when an overcurrent is generated, thereby suppressing an influence on a peripheral portion.

SUMMARY OF THE INVENTION

According to the constructions disclosed in both Patent Documents 1 and 2, the fusing portion is disconnected to thereby preventing the overcurrent from flowing in the peripheral portion. However, in those constructions, if the overcurrent is caused by a discharge current, there is a case where a new discharge further occurs and continues in the fusing portion. It is, therefore, demanded to certainly extinguish the discharge.

In consideration of the above problem, it is an object of the invention to provide an electron beam apparatus having a high reliability in which a discharge can be efficiently suppressed.

According to the invention, there is provided an electron beam apparatus comprising: a rear plate having a plurality of electron-emitting devices each provided with a device electrode, and a plurality of wirings connected to the device electrodes; and a face plate being provided with an anode electrode, and being arranged in opposition to the rear plate so as to be irradiated with an electron emitted from the electron-emitting device, wherein the device electrode is electrically connected to the wiring through an additional electrode, and the additional electrode is formed from an electroconductive material of which phase transition from a solid phase directly into a vapor phase is caused at a temperature not lower than a melting point of the device electrode within an evacuated atmosphere.

The electron beam apparatus of the invention includes the following constructions as exemplary embodiments.

The additional electrode is formed from molybdenum oxide, nickel oxide, tin oxide, copper oxide, or carbon.

The additional electrode has a high temperature portion of which temperature increases locally at a time of flowing current therethrough, and a distance L1 between the high temperature portion and a portion of the device electrode electrically closest to the wiring, and a distance P between the high temperature portion and the electron-emitting device closest to the high temperature portion meet a relation: $L1 \leqq P/5$.

The device electrode has, at a side of the wiring, an end portion shaped into an arc protruding to the wiring, and the wiring has, at a side of the device electrode, an end portion shaped into an arc along a circle of which center is at apposition electrically closest to the wiring having the arc.

A plurality of the device electrodes are provided, a plurality of first wirings connected to one of the paired device electrodes are provided, and a plurality of second wirings connected to the other of the paired device electrodes are provided and crossing the first wirings sandwiching therebetween an insulating layer.

In the invention, the electrical connection of the device electrode and the wiring is performed by the additional electrode and the additional electrode is formed from the material of which phase transition from the solid phase directly into the vapor phase is caused at the high temperature. Therefore, when the cathode spot caused on the device electrode by the discharge is moved toward the wiring, the device electrode cannot be connected on the additional electrode and is extinguished before it reaches the wiring. Thus, in the electron beam apparatus of the invention, the discharge is certainly suppressed and an influence on the peripheral portion can be prevented.

Particularly, in the invention, when the high temperature portion is provided at the distance close to the additional electrode of the device electrode, the movement distance of the cathode spot becomes short, so that a discharge connection time is shortened and the damage can be minimized.

Further, in the invention, at the side of the wiring, the end portion of the device electrode is shaped into the arc and, at the side of the device electrode, the end portion is shaped at the equal distance from the position which is electrically closest to the wiring of the device electrode, so that the concentration of the discharge current on the wiring connected to the additional electrode is suppressed. Consequently, even when the larger discharge current flows, the discharge can be extinguished.

Further features of the present invention will become apparent from the following description of exemplary embodiments with reference to the attached drawings.

DESCRIPTION OF THE EMBODIMENTS

Exemplary embodiments of the invention will be described hereinbelow.

As electron-emitting devices which are used in the invention, any of field emission type devices, MIM type devices, and surface conduction electron-emitting devices can be used. Particularly, the electron-emitting devices are applied to an electron beam apparatus which is generally called a high voltage type to which a voltage of a few kV or higher is applied from a viewpoint that a discharge is liable to occur.

An exemplary embodiment of the invention will be specifically described hereinbelow with respect to an example in which surface conduction electron-emitting devices are used as an electron source. A typical construction, manufacturing method, and characteristics of the surface conduction electron-emitting device have been disclosed in, for example, Japanese Patent Application Laid-Open No. H02-056822.

Figure 6:
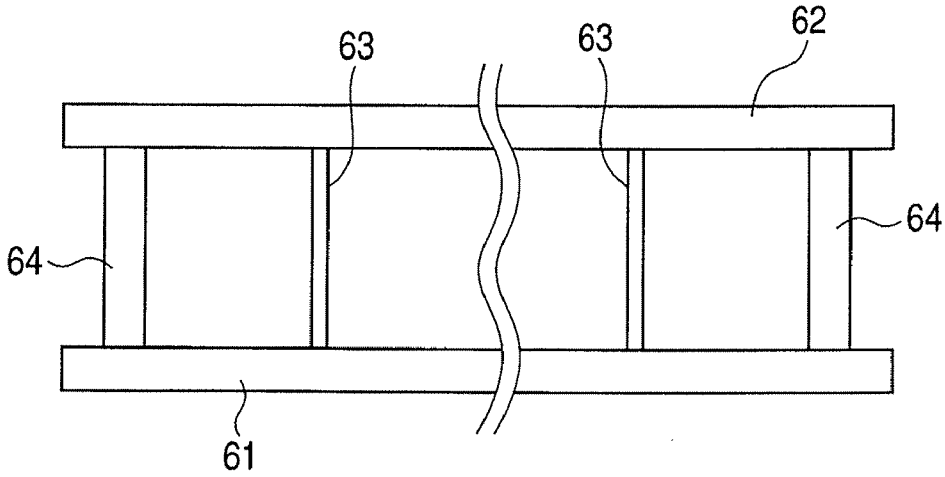
FIG. 6 is a schematic diagram illustrating a fundamental construction of the electron beam apparatus of the invention.

A fundamental construction of the electron beam apparatus of the invention is illustrated in FIG. 6. The electron beam apparatus has: a rear plate 61; a face plate 62 arranged so as to face the rear plate 61; and frame portions 64 which are fixed to peripheral edge portions of the plates 61 and 62 and construct an envelope together with the plates 61 and 62. Ordinarily, the electron beam apparatus has spacers 63 (component members such as plate-shaped members, pillar-shaped members, ribs, or the like) which hold a distance between the plates 61 and 62 and, at the same time, function as an atmospheric pressure resisting structure. The rear plate 61 is provided with electron sources and electrodes and wirings for driving the electron sources.

Figure 1:
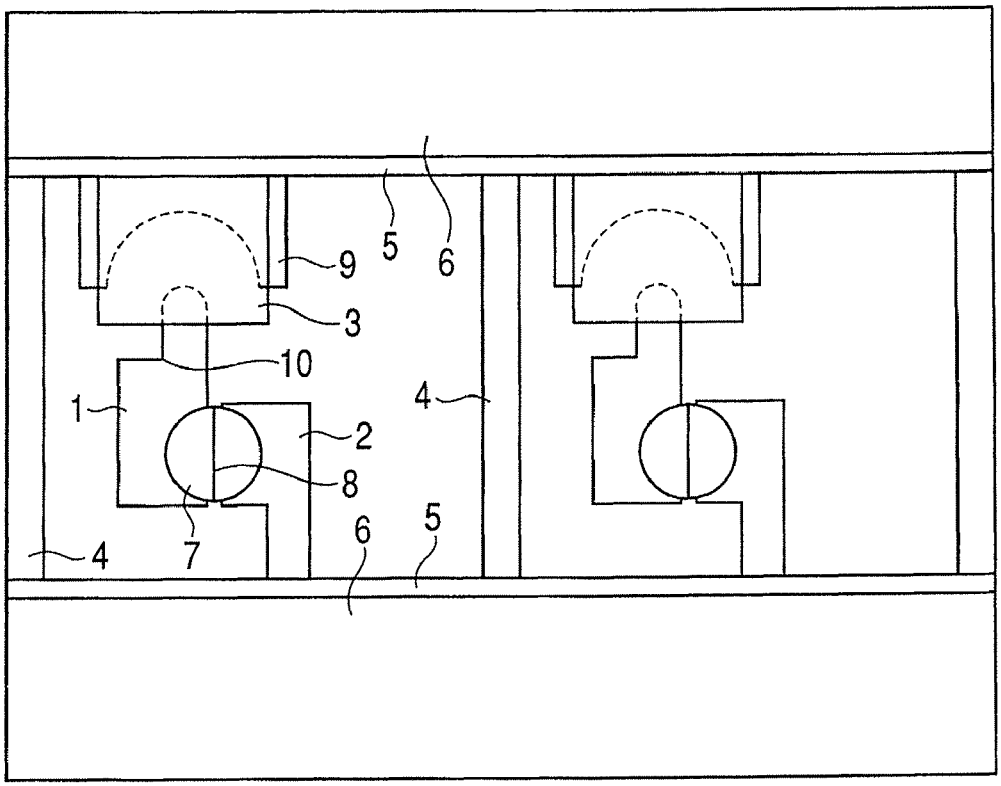
FIG. 1 is a plan view schematically illustrating an embodiment of an electron beam apparatus of the invention.

FIG. 1 is a plan view illustrating electron-emitting devices and wiring group corresponding to two devices on the rear plate 61 in the exemplary embodiment of the invention. In the diagram, there are provided: a scan signal device electrode 1; an information signal device electrode 2; an additional electrode 3; information signal wirings (second wirings) 4; insulating layers 5; scan signal wirings (first wirings) 6; a device film 7; an electron-emitting portion 8 formed on the device film 7; and an extension wiring 9 for connecting the scan signal wiring 6 and the additional electrode 3. The scan signal device electrode is provided with a high temperature portion 10. As illustrated in FIG. 1, a pair of device electrodes are formed by the scan signal device electrode 1 and the information signal device electrode 2.

FIGS. 2A to 2F illustrate manufacturing steps of the electron-emitting devices and the wirings of the rear plate in FIG. 1. Each step will be described hereinbelow.

Figure 2A:
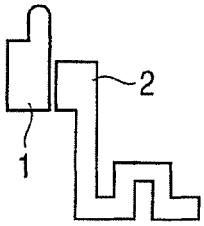
FIGS. 2A, 2B, 2C, 2D, 2E and 2F are plan views schematically illustrating manufacturing steps of a rear plate in FIG. 1.

First, the scan signal device electrode 1 and the information signal device electrode 2 are formed on a substrate (not shown) (FIG. 2A). The device electrodes 1 and 2 are provided in order to stabilize an electrical contact resistance between the wirings 6 and 4 and the device film 7. As a forming method of the device electrodes 1 and 2, a vacuum system film forming method such as vacuum evaporation depositing method, sputtering method, plasma CVD method, or the like is desirably used. It is desirable that each of the device electrodes 1 and 2 is a thin film having a thickness within a range from 0.01 to 0.3 μm from a viewpoint that a step difference from the device film 7 is small. As a material of the device electrodes 1 and 2, aluminum, titanium, chromium, nickel, copper, molybdenum, ruthenium, silver, tungsten, platinum, gold, or the like is used.

Figure 2B:
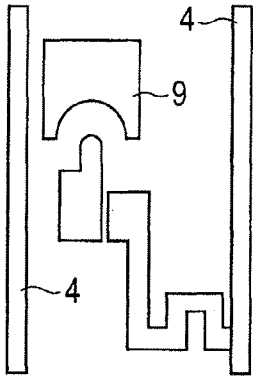

Subsequently, the information signal wirings 4 and the extension wiring 9 are formed (FIG. 2B). In the embodiment, the additional electrode 3 and the scan signal wiring 6 are electrically connected by the extension wiring 9. Although manufacturing steps differ, the extension wiring 9 is electrically a part of the scan signal wiring 6 in which a scan signal flows. It is desirable that each of the information signal wiring 4 and the extension wiring 9 has a low resistance by increasing their film thicknesses. As a forming method, there is a thick film printing method of printing and baking a thick film paste obtained by mixing an Ag component and a glass component into a solvent, an offset printing method using a Pt paste, or the like. A photopaste method using a photolithography technique for the thick film paste printing can be also applied.

The extension wiring 9 may be formed by the same material as that of the device electrodes 1 and 2 in the foregoing forming steps of the device electrodes 1 and 2.

Figure 2C:
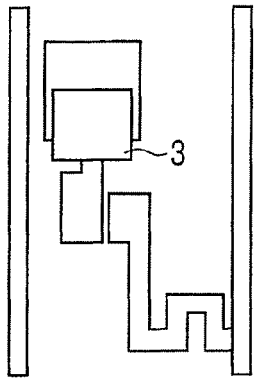

Subsequently, the additional electrode 3 is formed (FIG. 2C). The additional electrode 3 is located between the extension wiring 9 and the scan signal device electrode 1 and electrically connected thereto, respectively. The additional electrode 3 is made of what is called sublimational electroconductive material of which phase transition from a solid phase into a vapor phase is caused at a temperature not lower than a melting point of the device electrodes 1 and 2 within an evacuated atmosphere without passing through a liquid phase. As a specific material of the additional electrode 3, a molybdenum oxide, a nickel oxide, a tin oxide, a copper oxide, or carbon is desirably used. As a forming method, besides the vacuum system film forming method such as vacuum evaporation depositing method, sputtering method, plasma CVD method, or the like, a spin coating method, a spraying method, or the like may be used.

Figure 2D:
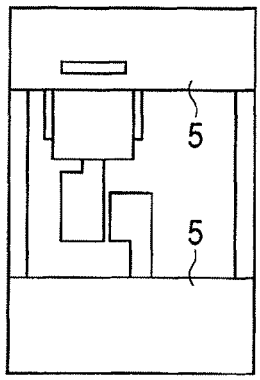

Subsequently, the insulating layers 5 are formed (FIG. 2D). The insulating layers 5 are provided in order to partially cover the information signal wirings 4 and prevent a short-circuit with the scan signal wirings 6 which are formed after that. An opening portion in a concave shape or a contact-hole type is provided in order to assure the connection between the extension wiring 9 and the scan signal wiring 6. As a material constructing the insulating layers 5, it is sufficient to use a dielectric material adapted to keep an insulation between the information signal wirings 4 and the scan signal wirings 6. For example, an insulative thick film paste or a photopaste may be used.

Figure 2E:
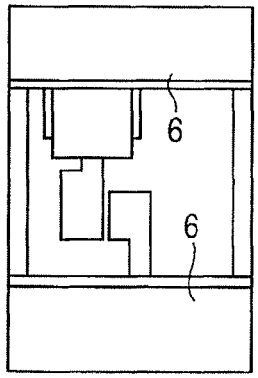

Subsequently, the scan signal wirings 6 are formed (FIG. 2E). As a forming method of the scan signal wirings 6, a method similar to that of the information signal wirings 4 can be applied.

Figure 2F:
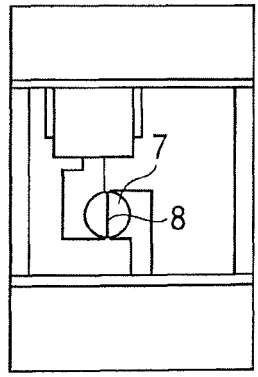

Finally, the device film 7 is formed and the electron-emitting portion 8 is formed (FIG. 2F).

Generally, as for a discharge occurring in the panel (envelope), a device discharge, a foreign matter discharge, or a projection discharge is mainly considered. The device discharge is a discharge which occurs when the electron-emitting device is destroyed by an overvoltage or the like and such a device destruction becomes a trigger. The foreign matter discharge is a discharge which occurs when a foreign matter enters the panel and while the foreign matter is moving. The projection discharge is a discharge which occurs when electrons are excessively emitted from an unnecessary projection in the panel. According to the invention, an effect is obtained for any of those discharges. In the foreign matter discharge and the projection discharge, in many cases, after the occurrence of the discharge, the discharge is moved to the electron-emitting device or the device electrode and substantially the same step as the device discharge is executed.

A case where the discharge has occurred in the embodiment will now be described with respect to the device discharge as an example.

Figure 3A:
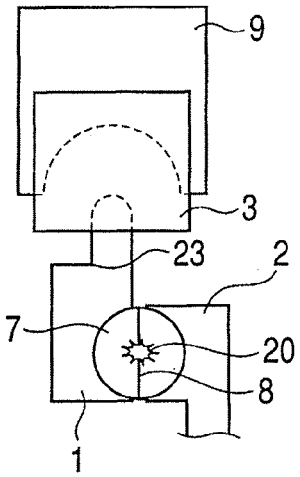
FIGS. 3A, 3B, 3C, 3D and 3E are diagrams illustrating typical discharge progressing steps in a device discharge occurring in the electron beam apparatus of the invention.
Figure 3B:
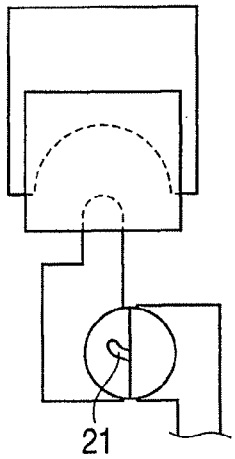
Figure 3C:
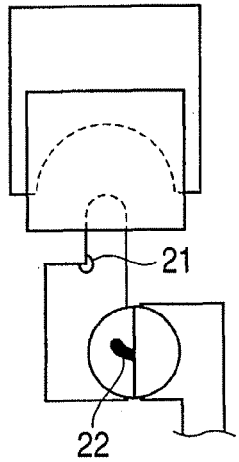

FIGS. 3A to 3E illustrate typical discharge progressing steps in the device discharge. First, when the overvoltage is applied to the electron-emitting portion 8 and a part of the device film 7 is destroyed, a device discharge 20 occurs (FIG. 3A). By using the occurrence of the device discharge as a trigger, a discharge current from an anode electrode provided for the face plate flows and the discharge progresses. The discharge current flows from the device film 7 into the device electrodes 1 and 2 connected thereto. However, in the embodiment, it is assumed that a resistance on the side of the scan signal device electrode 1 is sufficiently smaller than that on side of the information signal device electrode 2 and the discharge current mainly flows into the scan signal device electrode 1. A cathode spot 21 occurring in association with the discharge progresses on the scan signal device electrode 1 toward the scan signal wiring 6 (FIG. 3B). When an electrode width changes in the halfway like a scan signal device electrode 1 in the embodiment, a current concentration occurs in the portion where the electrode width is discontinuous and a temperature rises locally. Such a portion is called a high temperature portion 23 in the invention. When the device electrode 1 of the high temperature portion 23 is fused and destroyed, the cathode spot 21 is started to be produced and moved from the destroyed portion as a start point (FIG. 3C). The movement of the cathode spot 21 and the fusion of the electrode have been disclosed in Reference Document 4 (Contrib. Plasma Phys. 33 (1993) 4, 307-316) or the like.

Figure 3D:
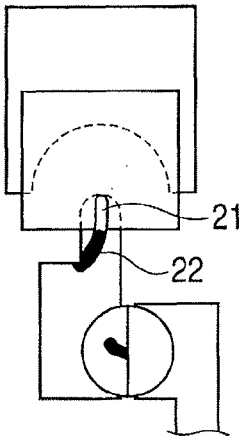
Figure 3E:
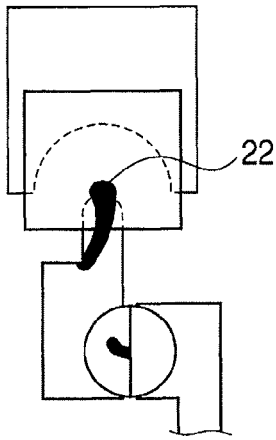

When the time further elapses, the cathode spot 21 reaches an end portion of the scan signal device electrode 1 (FIG. 3D). A damage 22 in which the electrode has been extinguished remains in the location where the cathode spot 21 has moved. Since the phase transition of the additional electrode 3 into the vapor phase occurs when the scan signal device electrode 1 is fused and evaporated, even if the damage 22 occurs, the cathode spot 21 is not formed in the additional electrode 3. That is, the cathode spot 21 does not progress beyond the scan signal device electrode 1 and the discharge is finally converged (FIG. 3E). In the portion where the additional electrode 3 has been laminated onto the scan signal device electrode 1, since the scan signal device electrode 1 maintains the cathode spot 21, the discharge is not converged in this location.

The temperature of the cathode spot 21 becomes very high since its current density is high and has reached a temperature near a boiling point of the device electrodes 1 and 2. Therefore, the temperature at which the phase transition of the additional electrode 3 into the vapor phase occurs may be a temperature about the boiling point of the device electrodes 1 and 2.

Figure 4:
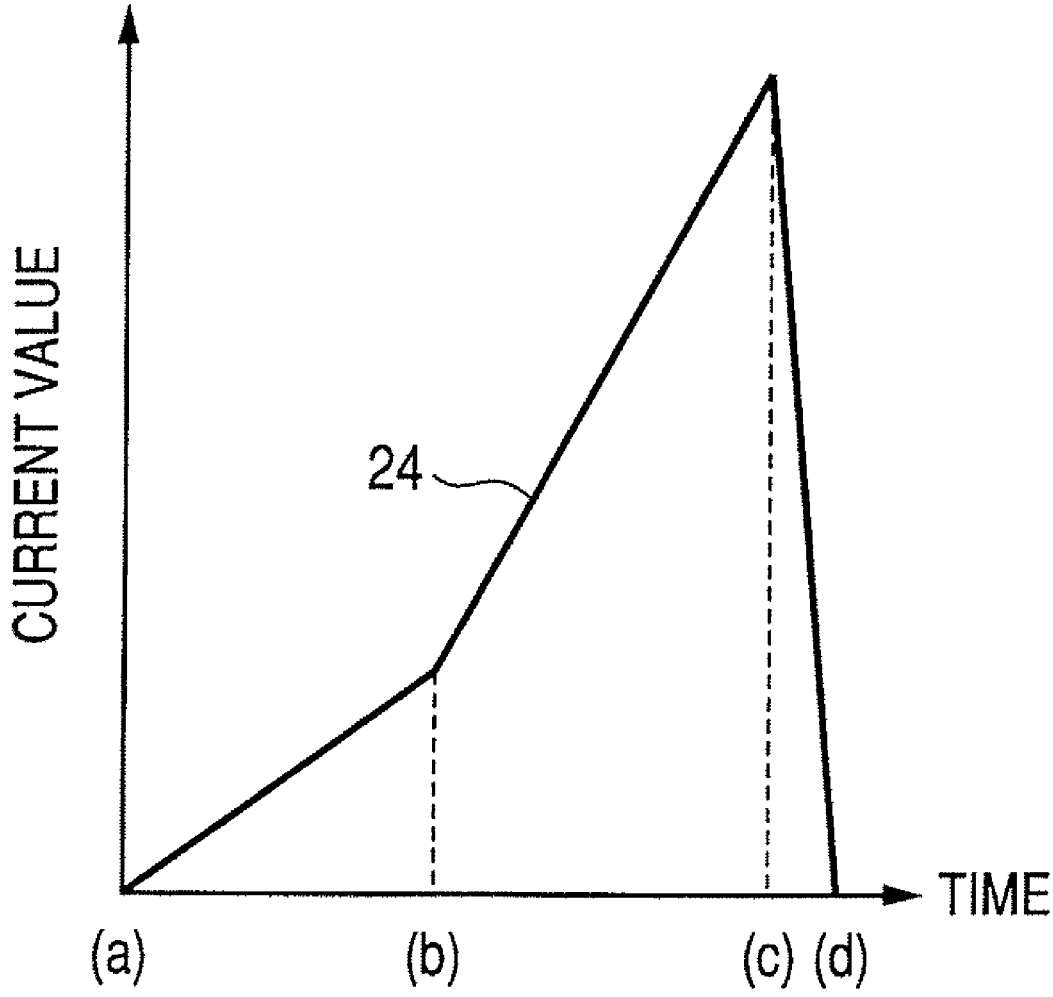
FIG. 4 is a diagram illustrating a typical discharge current waveform in the device discharge.

A schematic diagram of a discharge current 24 corresponding to the discharge progressing step in FIG. 3 is illustrated in FIG. 4. The discharge current 24 is generated in association with the occurrence of the device discharge ((a) of FIG. 4). When the cathode spot 21 is moved to the high temperature portion 23, an impedance of a discharge path changes, so that a discontinuity occurs in the discharge current 24 ((b) of FIG. 4). When the cathode spot 21 reaches the additional electrode 3 ((c) of FIG. 4) and the scan signal device electrode 1 around it is extinguished, the discharge is converged, so that the discharge current 24 does not flow ((d) of FIG. 4).

A similar effect is obtained even if the additional electrode 3 has partially been connected to the scan signal wiring 6 and the scan signal device electrode 1 or even if the whole additional electrode 3 has been vaporized and extinguished. A condition in which the cathode spot 21 is extinguished is that the scan signal device electrode 1 at a predetermined position is extinguished and such a condition is not concerned with the presence or absence of the remaining portion of the additional electrode 3.

The above steps are a phenomenon in the vacuum and, specifically speaking, it indicates a high vacuum whose vacuum degree is not larger than $1\times10^{-3}$ Pa. That is, it is sufficient that a material in which a pressure at what is called a triple point where sublimational characteristics appear is not larger than $1\times10^{-3}$ Pa is used.

Since the device electrodes 1 and 2 do not contribute to the discharge, a method whereby the electrode is constructed only by the additional electrode 3 without using the device electrodes 1 and 2 is also considered. However, it is difficult to use the material suitable for the additional electrode 3 because it generally has a high resistance or from viewpoints of adhesion with the device film 7, stability of film characteristics, and the like. It is, therefore, desirable to use such a construction that the electroconductive material of a low resistance is used for the device electrodes 1 and 2 and the device electrodes 1 and 2 are connected to the wirings 6 and 4 through the additional electrode 3. From the above reasons, in many cases, the thickness and length as a shape of the additional electrode 3 are specified from a viewpoint of the electrode resistance.

Figure 5A:
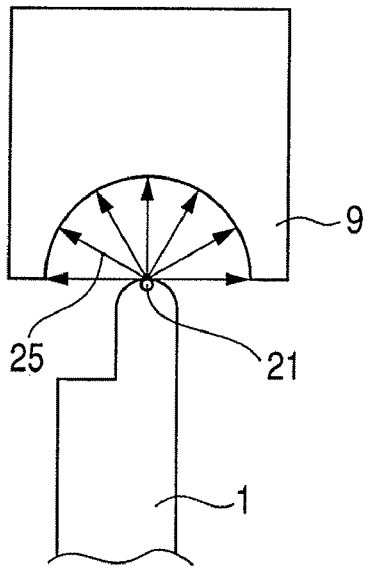
FIGS. 5A and 5B are diagrams schematically illustrating a discharge current flux which flows out from a cathode spot on a device electrode toward an extension wiring according to the invention.
Figure 5B:
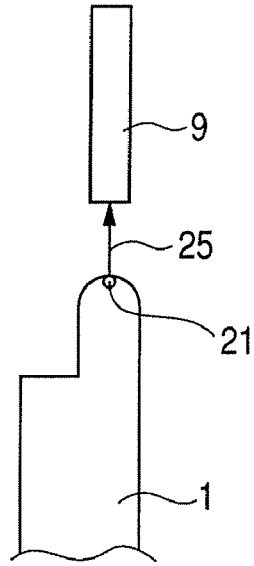

A restricting condition also exists in the shape of the extension wiring 9 connected to the additional electrode 3. FIG. 5A schematically illustrates the scan signal device electrode 1, the extension wiring 9, the cathode spot 21 in the case where it has reached the end portion of the scan signal device electrode 1, and a current flux 25 of the discharge current which flows out therefrom. Ordinarily, a maximum value of the discharge current in the electron beam apparatus is designed to about 0.1 to 3 A and the current flows into the extension wiring 9 through the cathode spot 21. Therefore, in dependence on a construction, there is a risk that the extension wiring 9 is fused and the discharge jumps over the additional electrode 3 and continues on the extension wiring 9. In the case where the end portion of the extension wiring 9 is shaped into the arc locating at the equal distance from the cathode spot 21 as illustrated in FIG. 5A, the current flux 25 flows radially toward the arc. However, a density of the current flowing into the end portion is small. On the other hand, in the construction in which, on the side of the device electrode 1, in the end portion of the extension wiring 9 a distance of the portion of a portion locating at the equal distance from the cathode spot 21 is short as illustrated in FIG. 5B, the density of the current flowing into the end portion is large and a risk that the extension wiring 9 is fused and the discharge continues is high.

To prevent the extension wiring 9 from being fused, it is desirable to use a method whereby an analysis is made by a finite-element solver in which a current field—heat conduction analysis have been coupled by using conditions such as material constant parameters of the component members including the extension wiring 9, discharge current value, cathode spot width, and the like and the extension wiring 9 is designed into such a shape that it does not exceed a melting point. Specific numerical values differ largely depending on the materials which are used and the shapes. For example, it is assumed that the extension wiring 9 is formed by using Ag so as to have a thickness of 1 to 10 μm and, on the side of the wiring 6, the end portion of the device electrode 1 is shaped into an arc protruding toward the wiring 6 side as illustrated in FIG. 1. The end portion of the extension wiring 9 is formed into an arc around the position on the arc (position of the cathode spot 21 in FIGS. 5A and 5B), as a center, that is electrically closest to the wiring 6. Thus, a withstanding property of the discharge current of a few A is obtained.

Figure 7:
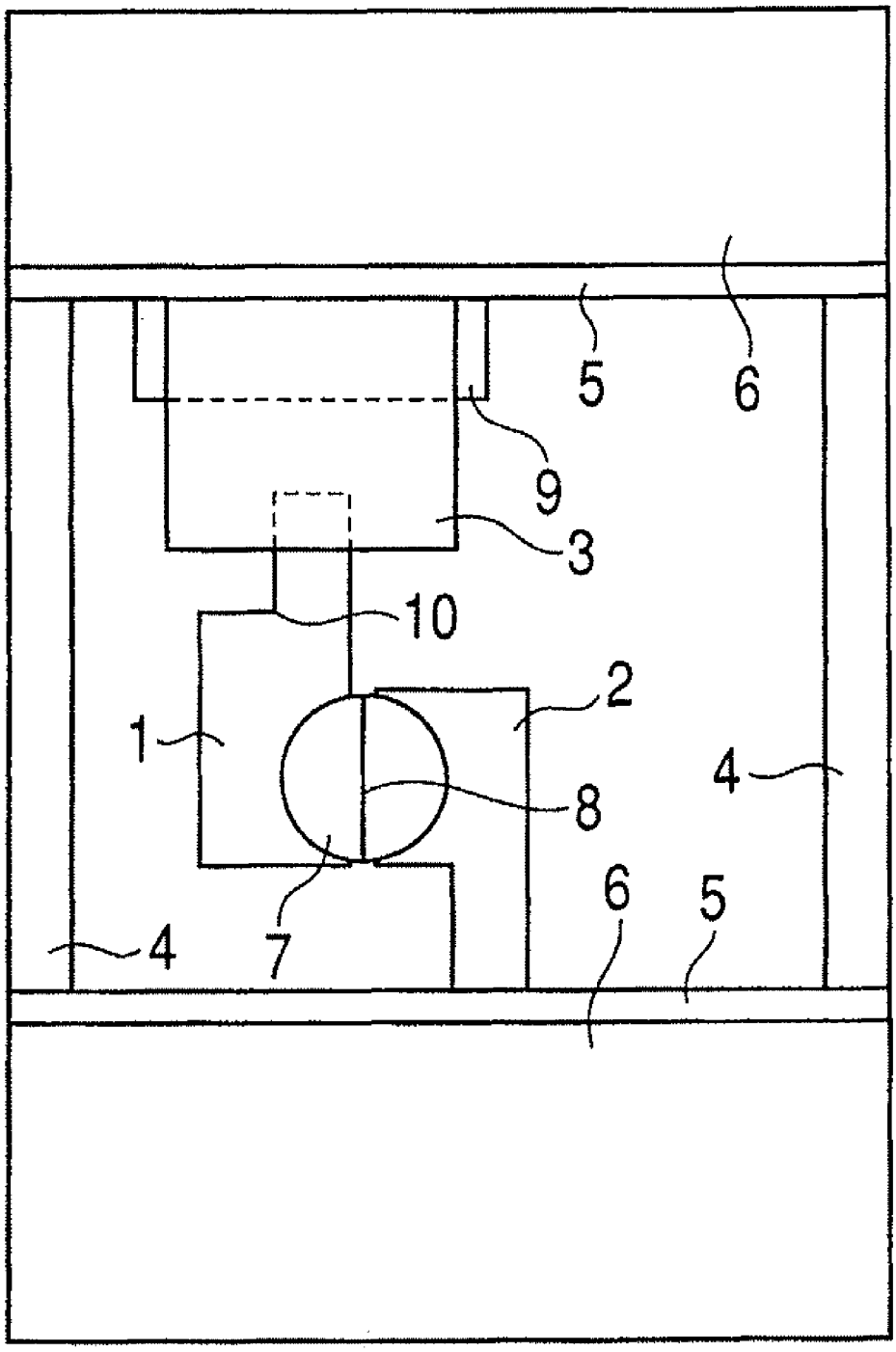
FIG. 7 is a plan view schematically illustrating another embodiment of the electron beam apparatus of the invention.

FIG. 7 schematically illustrates an electron-emitting device and a wiring group in a rear plate as another embodiment of the invention. This embodiment relates to an example in which, on the side of the wiring 6, the end portion of the device electrode 1 is shaped into a straight line and, on the side of the device electrode 1, the end portion of the extension wiring 9 is shaped into a straight line. In the invention, the device electrode 1, extension wiring 9, and additional electrode 3 may be formed into arbitrary shapes so long as they are designed so that the withstanding property against the target discharge current is further enhanced.

Figure 8:
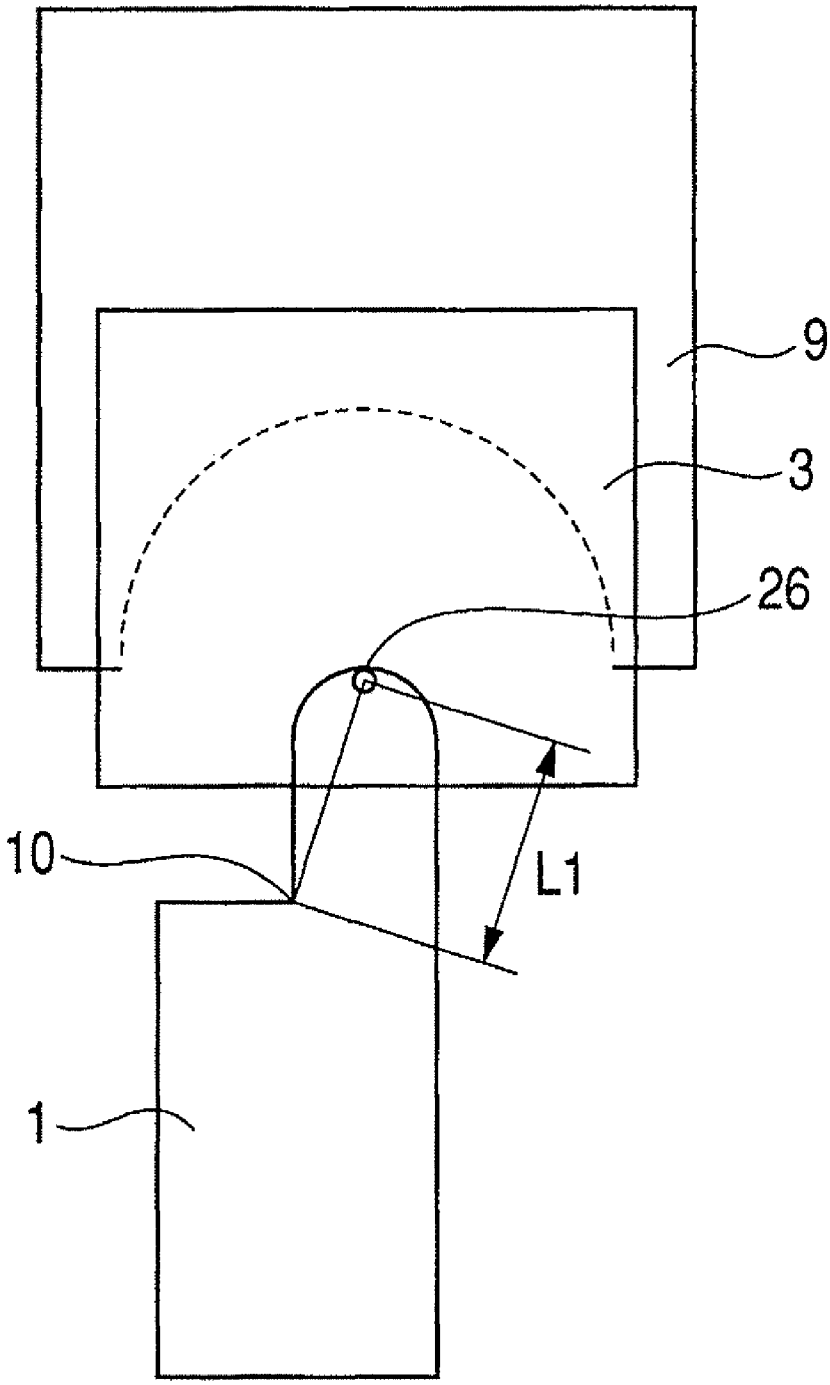
FIG. 8 is a diagram for describing a positional relation between a high temperature portion and an end portion of the device electrode in the invention.

The high temperature portion 23 on the scan signal device electrode 1 is a portion whose temperature rises locally when the current flows. It is desirable that the high temperature portion 23 is close to the position which is electrically closest to the scan signal wiring 6 (that is, the position where the resistance is the smallest until the scan signal wiring 6) in the connecting position of the scan signal device electrode 1 and the additional electrode 3. FIG. 8 illustrates such a relation.

In FIG. 8, a position 26 indicates a position, in the scan signal device electrode 1, which is electrically closest to the scan signal wiring 6. A distance L1 indicates a straight line connecting the position 26 to the high temperature portion 23. The position 26 also indicates a position at which the cathode spot 21 moving on the scan signal device electrode 1 finally arrives. It is desirable that the distance L1 is as short as possible. Specifically speaking, when defining a distance P between the high temperature portion 23 and the neighboring electron-emitting device, it is desirable that at least L1≦P/5 is satisfied. The reasons will be described hereinbelow.

When a time that is required until the discharge is settled is assumed to be τ and a progressing speed of the cathode spot 21 is assumed to be $V_{arc}$, $$\tau = L1/V_{arc}$$

The gas generated from the cathode spot 21 is diffused to the circumference at a speed $V_{gas}$ and reaches the neighboring electron-emitting device.

$$V_{gas} = (2RT/M)^{(1/2)}$$

R: gas constant=8.314772 J/molK

T: melting point temperature of the electrode

M: mass number of the blowout gas

There is a case where a discharge occurs in the neighboring electron-emitting device because of an increase in gas partial pressure. The relevant electron-emitting device and the neighboring electron-emitting device are continuously damaged and the damaged devices are conspicuous as defects. To avoid such a situation, the following conditions are necessary: an arrival time ($P/V_{gas}$) is longer than the foregoing time τ required until the discharge is settled with respect to the distance P between the cathode spot 21 (in this case, the high temperature portion 23) and the neighboring electron-emitting device and the speed $V_{gas}$ of the gas molecule. More specifically speaking, the distance P between the cathode spot 21 and the neighboring electron-emitting device is a distance from the cathode spot 21 to the electron-emitting portion 8 of the neighboring electron-emitting device.

That is, there are the following relation:

$$P/V_{gas} \geqq L1/V_{arc}$$

A condition of the distance L1 from the high temperature portion 23 to the position 26 is as follows.

$$L1 \leqq P \cdot V_{arc}/V_{gas}$$

Generally, there is a report showing that the speed $V_{arc}$ of the cathode spot is equal to 10 to 500 m/sec (HANDBOOK OF VACUUM ARC SCIENCE AND TECHNOLOGY, NO YES PUBLICATIONS, 1995, pp 86). According to the examinations of the present inventors et al., in the construction of the invention, $V_{arc} \approx 200$ m/sec. As for the gas speed $V_{gas}$, in the case of the invention, the electrode material and the gas such as Ar or the like which is fetched upon forming the electrode material film are dominant. Assuming that T is set to a value within a range from a melting point of the Pt electrode to the boiling point (2042 to 4100 K) and a mass number of the blowout gas is equal to (M=39.95) in the case of Ar, the gas speed $V_{gas}$ is equal to about 1000 m/sec. Therefore, the distance L1≦P/5 and in the high-precision image displaying apparatus, since P=about 200 μm, L1≦40 μm is a necessary condition.

The high temperature portion 23 is a portion whose temperature becomes the highest temperature when the electron-emitting device is driven. If the temperature rises locally, such a construction that not only the widths of the device electrodes 1 and 2 are changed but also their thicknesses are changed or a region where a radius of curvature of a corner portion is small is provided, thereby concentrating the current may be used. Such a construction that a region where a Joule's heat is high is provided by locally using high resistance material or the like can be also used. Although a plurality of high temperature portions 23 may exist, it is desirable to provide the high temperature portion 23 at one position because the cathode spot 21 can be easily controlled.

Figure 9:
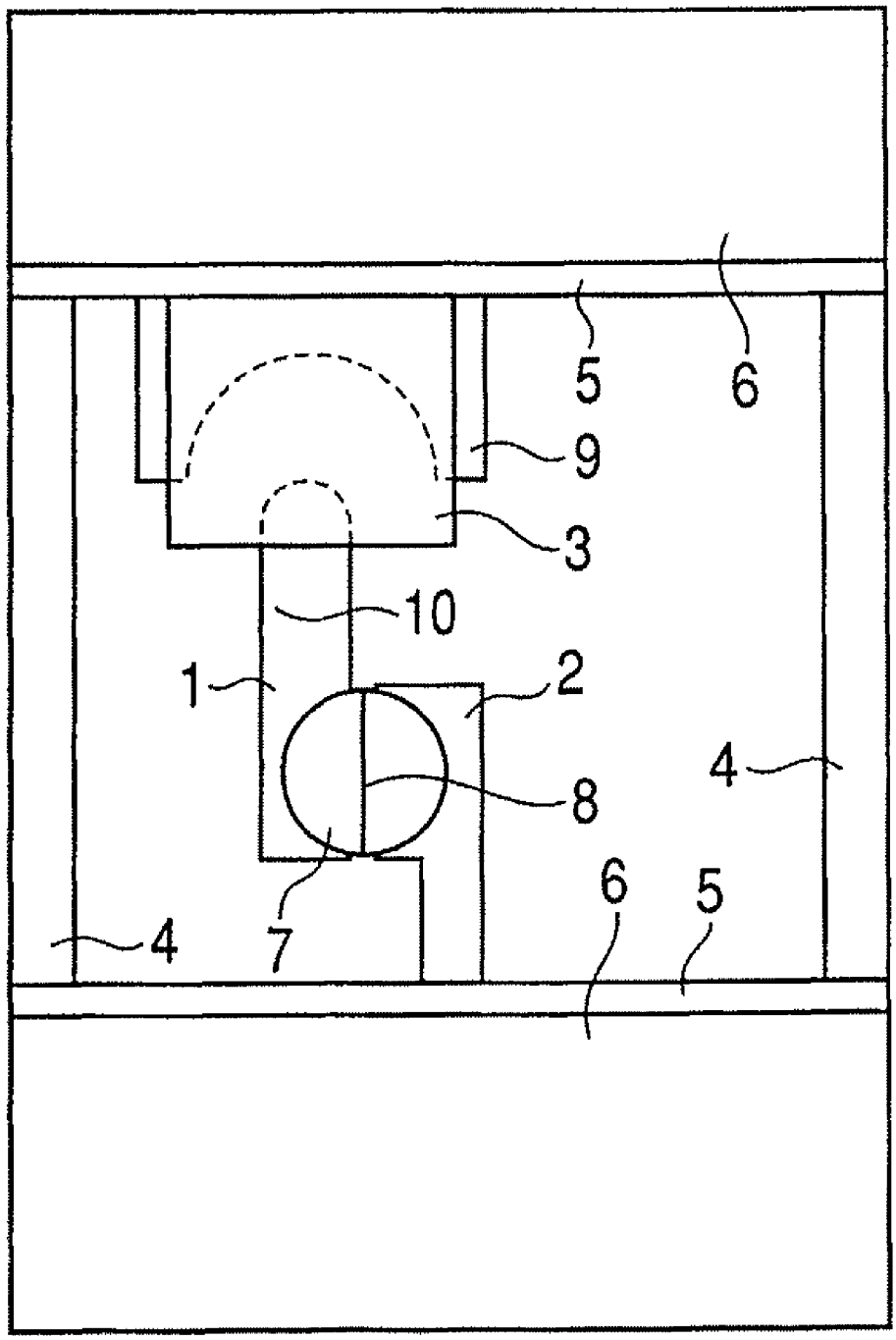
FIG. 9 is a plan view schematically illustrating still another embodiment of the electron beam apparatus of the invention.

FIG. 9 illustrates a constructional example in which no high temperature portion 23 is formed in the scan signal device electrode 1. In this case, the discharge is started from the electron-emitting portion 8 or from an arbitrary position on the device electrode 1.

Although the example in which the additional electrode 3 is connected to the scan signal device electrode 1 has been shown in the embodiment, if the discharge current also flows into the information signal device electrode 2, such a construction that the additional electrode 3 is provided on the information signal device electrode 2 side can be also used. Further, even if the vertical laminate relation between the information signal wiring 4 and the scan signal wiring 6 is reversed, similar operations and effects are obtained.

EXAMPLES

Although the invention will be described in detail hereinbelow with respect to specific Examples, the invention is not limited to those Examples.

Example 1

The rear plate illustrated in FIG. 1 is manufactured according to the steps illustrated in FIG. 2. In this example, glass having a thickness of 2.8 mm of PD-200 (made by Asahi Glass Co., Ltd.) in which an amount of alkali component is small is used as a substrate and, further, the glass substrate is coated with an $SiO_2$ film having a thickness of 200 nm as a sodium block layer.

<Forming of Device Electrodes>

A Ti/Pt film having a thickness of 5/20 nm is formed onto the glass substrate by a sputtering method. After that, the whole surface is coated with a photoresist. Subsequently, a patterning is performed by a series of photolithography technique such as exposure, development, and etching, thereby forming the scan signal device electrode 1 and the information signal device electrode 2 (FIG. 2A). The information signal device electrode 2 is formed in a zigzag shape so as to have a high resistance. An electrical resistivity of each of the device electrodes 1 and 2 is equal to $0.25\times10^{-6}$ [Ωm]. In the scan signal device electrode 1, a width of electrode connected to the device film 7 is set to 20 μm, a width of electrode connected to the additional electrode 3 is set to 10 μm, a front edge is semi-circular, and the distance L1 between the position 26 which is electrically closest to the scan signal wiring 6 and the high temperature portion 23 is set to 20 μm.

<Forming of Information Signal Wirings and Extension Wirings>

After a screen printing was executed by using photopaste ink of silver Ag, it is dried, exposed into a predetermined pattern, and developed. After that, it is baked at about 480K, thereby forming the information signal wirings 4 and the extension wiring 9 (FIG. 2B). A thickness of extension wiring 9 is set to about 10 μm, its width is set to 80 μm, its length is set to 150 μm, the end portion connected to the additional electrode 3 is semi-circular, and its diameter is set to 30 μm. A thickness of information signal wirings 4 is set to about 10 μm and its width is set to 20 μm. An electrical resistivity of the manufactured extension wiring 9 is measured and it is equal to $0.03\times10^{-6}$ [Ωm]. A final end portion (the side which is not in contact with the additional electrode 3) of the extension wiring 9 is connected to the scan signal wiring 6.

<Forming of Additional Electrode>

After the surface was coated with a photoresist by a spinning method, an exposure and a development are executed by using a predetermined pattern. Subsequently, the surface is coated with graphite by a spraying method and pre-baked at 80K. After that, the resist is peeled off and the surface is post-baked at 200K, thereby forming the additional electrode 3 (FIG. 2C). As a graphite paint used here, a paint obtained by dispersing microfine graphite into a solvent containing water as a main component is used. As a typical material, HITASOL (trademark, made by Hitachi Powdered Metals Co., Ltd.) has been known. A thickness of additional electrode 3 is set to about 1 μm, its width is set to 60 μm, and its length is set to 30 μm.

<Forming of Insulating Layers>

After a screen of a photosensitive paste containing PbO as a main component was printed under the scan signal wiring 6 which is formed in the post-step, it is exposed, developed, and finally baked at about 460K, thereby forming the insulating layers 5 each having a thickness of 30 μm and a width of 200 μm (FIG. 2D). In the insulating layers 5, an opening portion is formed in a region corresponding to the final end portion of the extension wiring 9.

<Forming of Scan Signal Wirings>

After a screen printing was executed by using Ag paste ink, it is dried and, thereafter, baked at about 450K, thereby forming the scan signal wirings 6 having a thickness of 10 μm and a width of 150 μm which cross the information signal wirings 4 onto the insulating layers 5 (FIG. 2E). Extraction wirings and extraction terminals to an external driving circuit are also similarly formed in the above step.

A resistance of the wiring group in this example is measured. A resistance of the line starting with the scan signal device electrode 1 on which the device film 7 is formed, passing through the scan signal wiring 6, and reaching the external driving circuit is equal to about 150Ω. A resistance of the line starting with the information signal device electrode 2, passing through the information signal wiring 4, and reaching the external driving circuit is equal to about 150Ω.

<Forming of Device Film and Electron-Emitting Portion>

After the substrate was sufficiently cleaned, the surface is processed with a solution containing a water repellent agent so as to be hydrophobic. A palladium-proline complex is dissolved into a mixed aqueous solution containing water and isopropyl alcohol (IPA) at a mixture ratio of 85:15 (v/v) so that a content in the aqueous solution is equal to 0.15 mass %, thereby adjusting a solution containing organic palladium. By an ink jet coating apparatus using a piezoelectric element, the solution containing organic palladium is adjusted so that a dot diameter is equal to 50 μm and applied between the device electrodes 1 and 2. After that, a heat baking process is executed at 350K for 10 minutes in the air, thereby obtaining a palladium oxide (PdO) film whose maximum thickness is equal to 10 nm.

By energizing and heating the palladium oxide film under an evacuated atmosphere containing a small amount of hydrogen gas, the palladium oxide is reduced, thereby forming the device film 7 made of palladium and, at the same time, forming the electron-emitting portion 8 into a part of the device film 7 (FIG. 2F).

Subsequently, trinitryl is introduced into the evacuated atmosphere and an energizing process is executed to the device film 7 under the evacuated atmosphere of $1.3\times10^{-4}$ Pa, thereby depositing carbon or a carbon compound near the electron-emitting portion.

<Forming of Display Panel>

The face plate 62 obtained by laminating a phosphor film as a light-emitting member and a metal-back as an anode electrode onto a glass substrate is prepared. The face plate 62 and the rear plate 61 manufactured in the above steps are arranged at the upper and lower positions. As illustrated in FIG. 6, the frame portions 64 are arranged in peripheral edge portions. A distance between the plates 62 and 61 is maintained to 2 mm by spacers 63, thereby sealing them. Thus, a matrix display panel in which the number of pixels is equal to 3072×768 and a pixel pitch is equal to 200×600 μm is obtained. The face plate 62 is connected between the metal-backs of each pixel through a resistor member of tens of kΩ, thereby providing a current limiting effect to the discharge current.

Example 2

A rear plate with a construction illustrated in FIG. 7 is manufactured. Since its manufacturing steps are similar to those in FIG. 2, their description is omitted here.

A thickness of extension wiring 9 is set to about 10 μm, its width is set to 80 μm, and its length is set to 130 μm. A thickness of additional electrode 3 is set to about 1 μm, its width is set to 60 μm, and its length is set to 30 μm.

In the scan signal device electrode 1, a width of electrode connected to the device film 7 is set to 20 μm and a width of electrode connected to the additional electrode 3 is set to 10 μm, and the distance L1 between the position 26 which is electrically closest to the scan signal wiring 6 and the high temperature portion 23 is set to 15 μm.

Example 3

The rear plate is manufactured in a manner similar to Example 1 except that the device electrodes 1 and 2 and the extension wiring 9 are simultaneously made of the same material.

Comparison 1

Figure 10:
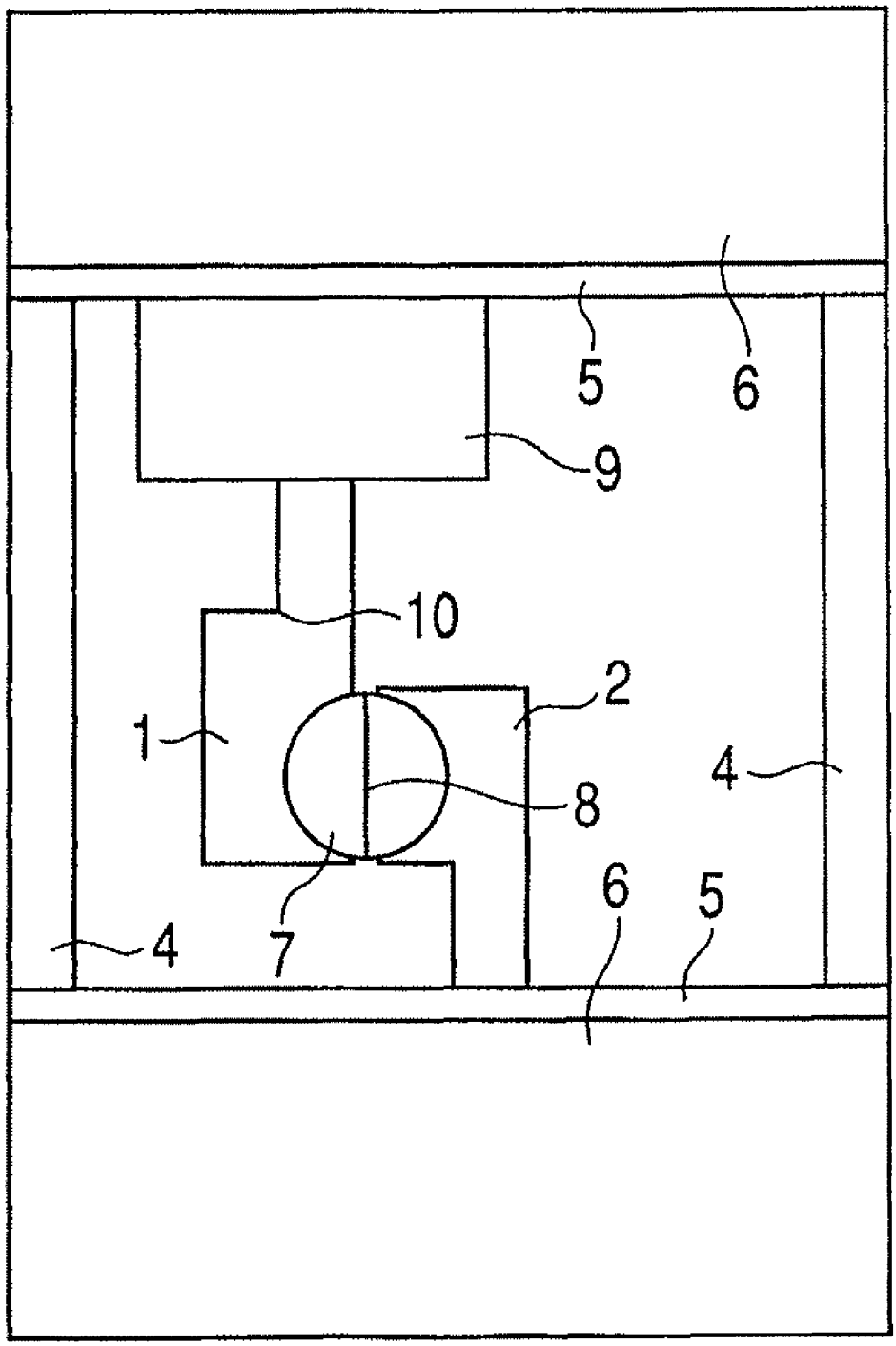
FIG. 10 is a schematic plan view of a comparison of the invention.

As Comparison 1, a rear plate with a construction illustrated in FIG. 10 in which no additional electrode 3 is provided is manufactured. Since its manufacturing steps are similar to those in FIG. 2 except for the additional electrode 3 in FIG. 2, their description is omitted here. A thickness of extension wiring 9 is set to about 10 μm, its width is set to 80 μm, and its length is set to 150 μm.

<Evaluation>

The ordinary image display operations are executed with respect to the display panels of Examples 1 to 3 and Comparison 1 obtained as mentioned above, so that good display results are obtained in all of the display panels.

Subsequently, discharge experiments in which the device discharge is artificially induced by applying an overvoltage to the electron-emitting devices are executed in order to confirm the effects of the invention. First, at the center of the panel, the electron-emitting devices other than the pixel at a proper address (X, Y) in the position away from the spacers and its three peripheral pixels are removed. This is because in the discharge experiments, if the electron-emitting devices are connected onto the wiring to be driven, when the voltage is applied, the current according to the device characteristics is added to the discharge current. As a removing method of the electron-emitting devices, such a device removal is realized by irradiating a YAG laser from the back surface of the rear plate to the device film 7. Since the device film 7 is a very thin film, it can be removed even at a low power.

Subsequently, a voltage of 1 to 10 kV is applied to the anode electrode of the face plate, a voltage of −10 to 20 V is applied as a scan signal, and a voltage of +10 to 20 V is applied as an information signal, respectively. At the same time, the voltage on the voltage applied line and a current waveform are monitored by using a voltage probe and a current probe.

In the example, since a resistance of a voltage applying path on the scan signal side is smaller than that on the information signal side, most of the discharge current flows to the scan signal wiring. In an electric circuit manner, a shunt ratio of (the scan signal side:the information signal side) is equal to (10:1). However, as illustrated in FIG. 3, since the cathode spot 21 moves on the scan signal device electrode 1 and the device film 7 is destroyed to thereby raise the resistance, the current flowing to the information signal side may be regarded to be almost zero. Actually, the discharge current from the information signal wiring 4 is equal to 20 mA or less.

Figure 11A:
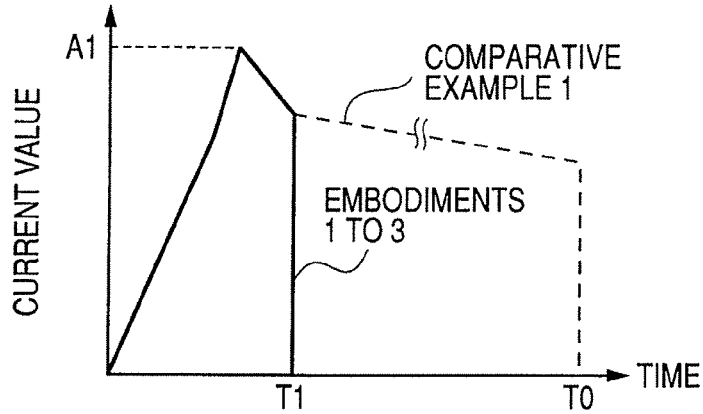
FIGS. 11A, 11B, and 11C are diagrams illustrating discharge current waveforms in the embodiment of the invention.
Figure 11B:
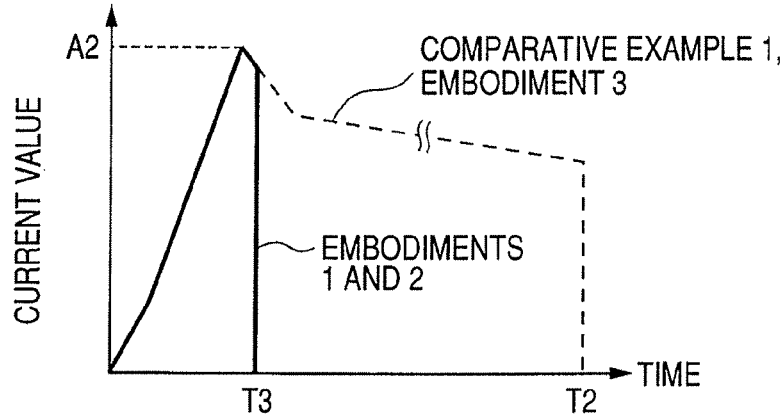
Figure 11C:
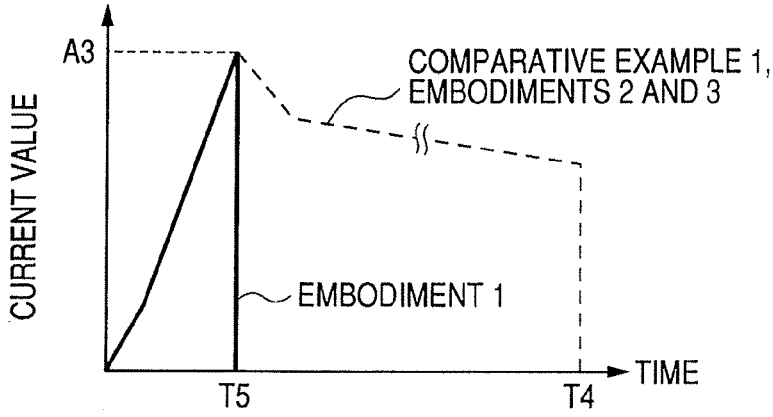

FIGS. 11A to 11C illustrate schematic diagrams of waveforms of the discharge current output from the scan signal wiring 6 in the embodiment. In the embodiment, values of times T0 to T5 and currents A1 to A3 in FIGS. 11A to 11C are as follows.

T0: 100 μs
T1: 0.33 μs
T2: 40 μs
T3: 0.25 μs
T4: 10 μs
T5: 0.2 μs
A1: 0.3A
A2: 0.8A
A3: 3.0A

Current values of A1 to A3 are adjusted based on a value of the voltage applied to the face plate. In the case of the current value of A1, the discharge is finished for a time T1 in Examples 1 to 3. In the case of the current value of A2, the discharge is finished for a time T3 in Examples 1 and 2. In the case of the current value of A3, the discharge is finished for a time T5 in Example 1.

Pixel damages of the rear plate are observed after the discharge experiments, so that in all of the display panels of Examples 1 to 3 and Comparison 1, the damages caused by the discharge are confirmed only in the pixel in which the discharge has been generated. However, when the three peripheral pixels in which the electron-emitting devices remain are driven, the light emission of the display panels in which the discharge is not finished for the short time (T1, T3, T5) is slightly deteriorated after the discharge. It is presumed that this is because since the discharge has been continued for a long time, the members of the rear plate are fused and evaporated and cause the damages to the peripheral electron-emitting devices.

In the embodiment, a distance from the high temperature portion 23 to the neighboring electron-emitting device is equal to about 200 μm. Therefore, it is sufficient that the distance L1 between the position 26 and the high temperature portion 23 is equal to the following value.

$$L1 \leqq P/5 = 40\ \mu m$$

Examples 1 to 3 satisfy the condition of the above equation. When the pattern of the scan signal device electrode 1 is changed and the distance L1 is changed and an examination is made, the damage can be confirmed in the neighboring electron-emitting device at the distance L1 over the value in the above equation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-096402, filed Apr. 2, 2007, which is hereby incorporated by reference herein in its entirety.

What is claimed is:

1. An electron beam apparatus comprising:

a rear plate having a plurality of electron-emitting devices each provided with a device electrode, and a plurality of wirings connected to the device electrodes; and a face plate being provided with an anode electrode, and being arranged in opposition to the rear plate so as to be irradiated with an electron emitted from at least one of the electron-emitting devices, wherein for each device electrode the device electrode is electrically connected to the wiring through an additional electrode, and the additional electrode is formed from an electroconductive material of which phase transition from a solid phase directly into a vapor phase is caused at a temperature not lower than a melting point of the device electrode within an evacuated atmosphere, the device electrode has a high temperature portion of which temperature increases locally at a time of flowing current therethrough, and a distance L1 between the high temperature portion and a portion of the device electrode electrically closest to the wiring, and a distance P between the high temperature portion and the electron-emitting device closest to the high temperature portion meet a relation:

$$L1 \leqq P/5.$$

2. The apparatus according to claim 1, wherein the additional electrode is formed from molybdenum oxide, nickel oxide, tin oxide, copper oxide, or carbon.

3. An electron beam apparatus comprising:

rear plate having a plurality of electron-emitting devices each provided with a device electrode, and a plurality of wirings connected to the device electrodes; and a face plate being provided with an anode electrode, and being arranged in opposition to the rear plate so as to be irradiated with an electron emitted from at least one of the electron-emitting devices, wherein for each device electrode the device electrode is electrically connected to the wiring through an additional electrode, and the additional electrode is formed from an electroconductive material of which phase transition from a solid phase directly into a vapor phase is caused at a temperature not lower than a melting point of the device electrode within an evacuated atmosphere, the device electrode has, at a side of the wiring, an end portion shaped into an arc protruding to the wiring, and the wiring has, at a side of the device electrode, an end portion shaped into an are along a circle of which center is at apposition electrically closest to the wiring having the arc.

4. The apparatus according to claim 1, wherein the plurality of device electrodes include a plurality of pairs of device electrodes, the plurality of wirings include a plurality of first wirings connected to one of the paired device electrodes and a plurality of second wirings connected to another of the paired device electrodes and crossing the first wirings sandwiching therebetween an insulating layer.

5. The apparatus according to claim 3, wherein the additional electrode is formed from molybdenum oxide, nickel oxide, tin oxide, copper oxide, or carbon.

6. The apparatus according to claim 3, wherein the additional electrode has a high temperature portion of which temperature increases locally at a time of flowing current therethrough, and a distance L1 between the high temperature portion and a portion of the device electrode electrically closest to the wiring, and a distance P between the high temperature portion and the electron-emitting device closest to the high temperature portion meet a relation:

$$L1 \leqq P/5.$$

7. The apparatus according to claim 3, wherein the plurality of device electrodes include a plurality of pairs of device electrodes, the plurality of wirings include a plurality of first wirings connected to one of the paired device electrodes and a plurality of second wirings connected to another of the paired device electrodes and crossing the first wirings sandwiching therebetween an insulating layer.

* * * * *